US008723445B2

(12) United States Patent
Sun et al.

(10) Patent No.: US 8,723,445 B2
(45) Date of Patent: May 13, 2014

(54) LIGHT POWER COMPENSATION DEVICE, LIGHT POWER COMPENSATION CIRCUIT, AND DETECTING MODULE

(75) Inventors: Tai-Ping Sun, Taoyuan County (TW); Chia-Hung Wang, Taichung (TW); Huei-Jyun Lin, Changhua County (TW)

(73) Assignee: National Chi Nan University, Nantou (TW)

( * ) Notice: Subject to any disclaimer, the term of this patent is extended or adjusted under 35 U.S.C. 154(b) by 302 days.

(21) Appl. No.: 13/213,719

(22) Filed: Aug. 19, 2011

(65) Prior Publication Data

US 2012/0268015 A1 Oct. 25, 2012

(30) Foreign Application Priority Data

Apr. 20, 2011 (TW) ..... 100113686 A

(51) Int. Cl.
*H05B 37/02* (2006.01)

(52) U.S. Cl.
USPC ..... 315/299; 315/308

(58) Field of Classification Search
USPC ..... 315/291, 299, 307, 308, 309
See application file for complete search history.

(56) References Cited

U.S. PATENT DOCUMENTS

| | | | | |
|---|---|---|---|---|
| 8,283,876 | B2 * | 10/2012 | Ji | 315/309 |
| 8,471,565 | B2 * | 6/2013 | Nguyen et al. | 324/414 |
| 2009/0278514 | A1 * | 11/2009 | Sun et al. | 323/265 |
| 2010/0156467 | A1 * | 6/2010 | Sun et al. | 326/96 |
| 2010/0315019 | A1 * | 12/2010 | Hoogzaad et al. | 315/291 |

FOREIGN PATENT DOCUMENTS

JP 2009-038218 * 2/2009

* cited by examiner

*Primary Examiner* — Thuy Vinh Tran
(74) *Attorney, Agent, or Firm* — Fox Rothschild, LLP; Robert J. Sacco

(57) ABSTRACT

A light power compensation circuit includes a current source to be electrically coupled to a temperature-detecting light-emitting device and providing a working current for the temperature-detecting light-emitting device, a detector unit operable to detect a forward bias voltage across the temperature-detecting light-emitting device and providing a detector voltage proportional to the forward bias voltage, a compensation voltage converting module converting the detector voltage into a compensation voltage which has a negative relation to change in the detector voltage, and a driving module converting the compensation voltage into a driving current which is proportional to the compensation voltage and which drives operation of a controlled light-emitting device.

18 Claims, 13 Drawing Sheets

LIGHT POWER COMPENSATION DEVICE, LIGHT POWER COMPENSATION CIRCUIT, AND DETECTING MODULE

CROSS-REFERENCE TO RELATED APPLICATION

This application claims priority of Taiwanese Application No. 100113686, filed on Apr. 20, 2011.

BACKGROUND OF THE INVENTION

1. Field of the Invention

The present invention relates to a device, a circuit and a module, more particularly to a light power compensation device, a light power compensation circuit and a detecting module.

2. Description of the Related Art

A forward bias voltage across a light-emitting diode (LED) may be influenced by environmental temperature. Referring to FIG. 1, each of three kinds of LEDs (blue LED, green LED and red LED) is driven by a constant 20 mA working current. When environmental temperature rises, the forward bias voltage of each of the LEDs drops, such that light power of each of the LEDs is reduced with rising environmental temperature. Therefore, simple utilization of a LED without performing power control thereon may result in a situation of unstable light power.

Referring to FIG. 2, a conventional light power compensation circuit 1 of an automatic power controller is disclosed in Taiwanese Patent No. I225190. The light power compensation circuit 1 is adapted to control light power of a LED 15 (or a laser diode) which acts as an optical head in an optical disc drive device. The light power compensation circuit 1 includes a sensor module 10, an integrator module 12, a signal source 11 and a driver module 13.

The sensor module 10 is for receiving light beams emitted from the LED 15 so as to detect light power thereof, and so as to generate a sensor voltage V3 which has a magnitude proportional to the light power of the LED 15. The light power satisfies: $P=VF\times I$, in which P represents the light power of the LED 15, VF represents a forward bias voltage of the LED 15, and I represents a driving current of the LED 15. The sensor module 10 includes a photodetector 101 and a front-end amplifier 102. Detailed operations of the photodetector 101 and the front-end amplifier 102 are disclosed in Taiwanese Patent No. I225190.

The signal source 11 provides a reference voltage V1, and a value of the reference voltage V1 may be adjusted according to different anticipated light power.

The integrator module 12 is electrically coupled to the signal source 11 for receiving the reference voltage V1, is electrically coupled to the sensor module 10 for receiving the sensor voltage V3, and performs integration operation on a voltage difference between the reference voltage V1 and the sensor voltage V3 so as to obtain an integration voltage V2. When the light power decreases, the sensor voltage V3 decreases along with the light power such that the voltage difference increases and such that the integration voltage V2 increases along with the voltage difference. On the contrary, when the light power increases, the sensor voltage V3 increases along with the light power such that the voltage difference decreases and such that the integration voltage V2 decreases along with the voltage difference.

The driver module 13 is electrically coupled between the integrator module 12 and the LED 15. The driver module receives the integration voltage V2 from the integrator module 12, and outputs, according to the integration voltage V2, a driving current I proportional to the integration voltage V2 so as to drive the LED 15. The driver module 13 includes a gain-switchable amplifier 131 and a driving unit 132. Detailed operations of the gain-switchable amplifier 131 and the driving unit 132 are disclosed in Taiwanese Patent No. I225190.

When the forward bias voltage VF of the LED 15 drops with rising environmental temperature such that the light power of the LED 15 is reduced, the sensor voltage V3 generated by the sensor module 10 decreases accordingly. Furthermore, since the reference voltage V1 remains unchanged, the voltage difference V1-V3 between the reference voltage V1 and the sensor voltage V3 increases accordingly such that the integration voltage V2 and the driving current I correspondingly increase. Therefore, by increase of the driving current I for compensating decreased forward bias voltage VF, the light power P may remain fixed.

It is apparent from the foregoing that the conventional light power compensation circuit 1 adopts the photodetector 101 of the sensor module 10 for detecting a variation in light beams emitted from the LED 15 so as to obtain a variation in the light power of the LED 15. Subsequently, the conventional light power compensation circuit 1 adjusts the driving current I provided to the LED 15 according to a variation in the sensor voltage V3, such that an object that the light power of the LED 15 remains steady may be achieved. However, the conventional light power compensation circuit 1 has the following drawbacks:

Since directivity of the light beams emitted from the LED 15 is insufficient, positions of each of the photodetector 101 and the LED 15, a distance therebetween, ambient light interference and sensitivity of the photodetector 101 may affect the sensor voltage V3. Therefore, control of the light power may be inaccurate. Moreover, the sensor voltage V3 generated from the output of the photodetector 101 has different values for different wavelengths of the light beams emitted from the LED 15. Therefore, in view of the aforementioned reasons, the light power compensation circuit 1 which adopts the photodetector 101 may hardly keep the light power of the LED 15 steady when environmental temperature changes.

SUMMARY OF THE INVENTION

Therefore, a first object of the present invention is to provide a light power compensation device capable of promoting an effect of keeping light power steady.

Accordingly, the light power compensation device is for compensating light power of a controlled light-emitting device. The controlled light-emitting device is a controlled light-emitting diode (LED) or a controlled laser diode. The controlled light-emitting device has an anode for connection to a voltage node, and a cathode. The light power compensation device comprises:

a temperature-detecting light-emitting device which provides a forward bias voltage thereacross that varies in a negative relation to change in environmental temperature when driven under a constant current, and which has an anode and a cathode. The temperature-detecting light-emitting device is a temperature-detecting LED or a temperature-detecting laser diode; and a light power compensation circuit electrically coupled to the temperature-detecting light-emitting device and to be electrically coupled to the controlled light-emitting device.

The light power compensation circuit includes:

a detecting module including:

a current source electrically coupled to the temperature-detecting light-emitting device, and providing a working current for the temperature-detecting light-emitting device; and a detector unit having a first detector input terminal electrically coupled to the anode of the temperature-detecting light-emitting device, a second detector input terminal electrically coupled to the cathode of the temperature-detecting light-emitting device, and a detector output terminal, the detector unit detecting the forward bias voltage across the temperature-detecting light-emitting device and providing a detector voltage at the detector output terminal, the detector voltage being proportional to the forward bias voltage;

a compensation voltage converting module having a first compensator input terminal for receiving a first reference voltage, a second compensator input terminal for receiving a second reference voltage, and a third compensator input terminal electrically coupled to the detector output terminal for receiving the detector voltage, the compensation voltage converting module converting the detector voltage with reference to the first and second reference voltages into a compensation voltage which has a negative relation to change in the detector voltage; and a driving module having a driver input terminal electrically coupled to the compensation voltage converting module for receiving the compensation voltage, and a driver output terminal to be electrically coupled to the cathode of the controlled light-emitting device, the driving module converting the compensation voltage into a driving current which is proportional to the compensation voltage and which drives operation of the controlled light-emitting device.

A second object of the present invention is to provide a light power compensation circuit.

Accordingly, the light power compensation circuit is for connecting electrically to a temperature-detecting light-emitting device and a controlled light-emitting device. The temperature-detecting light-emitting device is a temperature detecting light-emitting diode (LED) or a temperature-detecting laser diode, and the controlled light-emitting device is a controlled LED or a controlled laser diode. Each of the temperature-detecting light-emitting device and the controlled light-emitting device has an anode and a cathode. The anode of the temperature-detecting light-emitting device is electrically coupled to a voltage node. The temperature-detecting light-emitting device provides a forward bias voltage thereacross that varies in a negative relation to change in environmental temperature when driven under a constant current. The light power compensation circuit comprises:

a detecting module including:

a current source to be electrically coupled to the temperature-detecting light-emitting device, and providing a working current for the temperature-detecting light-emitting device; and a detector unit having a first detector input terminal to be electrically coupled to the anode of the temperature-detecting light-emitting device, a second detector input terminal to be electrically coupled to the cathode of the temperature-detecting light-emitting device, and a detector output terminal, the detector unit being operable to detect the forward bias voltage across the temperature-detecting light-emitting device and providing a detector voltage at the detector output terminal, the detector voltage being proportional to the forward bias voltage;

a compensation voltage converting module having a first compensator input terminal for receiving a first reference voltage, a second compensator input terminal for receiving a second reference voltage, and a third compensator input terminal electrically coupled to the detector output terminal for receiving the detector voltage, the compensation voltage converting module converting the detector voltage with reference to the first and second reference voltages into a compensation voltage which has a negative relation to change in the detector voltage; and a driving module having a driver input terminal electrically coupled to the compensation voltage converting module for receiving the compensation voltage, and a driver output terminal to be electrically coupled to the cathode of the controlled light-emitting device, the driving module converting the compensation voltage into a driving current which is proportional to the compensation voltage and which drives operation of the controlled light-emitting device.

A third object of the present invention is to provide a detecting module.

Accordingly, the detecting module is to be electrically coupled to a temperature-detecting light-emitting device. The temperature-detecting light-emitting device is a temperature-detecting light-emitting diode (LED) or a temperature-detecting laser diode. The temperature-detecting light-emitting device provides a forward bias voltage thereacross that varies in a negative relation to change in environmental temperature when driven under a constant current, and has a cathode and an anode. The detecting module comprises:

a current source to be electrically coupled to the temperature-detecting light-emitting device, and providing a working current for the temperature-detecting light-emitting device; and a detector unit having a first detector input terminal to be electrically coupled to the anode of the temperature-detecting light-emitting device, a second detector input terminal to be electrically coupled to the cathode of the temperature-detecting light-emitting device, and a detector output terminal, the detector unit being operable to detect the forward bias voltage across the temperature-detecting light-emitting device and providing a detector voltage at the detector output terminal, the detector voltage being proportional to the forward bias voltage.

BRIEF DESCRIPTION OF THE DRAWINGS

Other features and advantages of the present invention will become apparent in the following detailed description of the four preferred embodiments with reference to the accompanying drawings, of which.

DETAILED DESCRIPTION OF THE PREFERRED EMBODIMENTS

Figure 1:
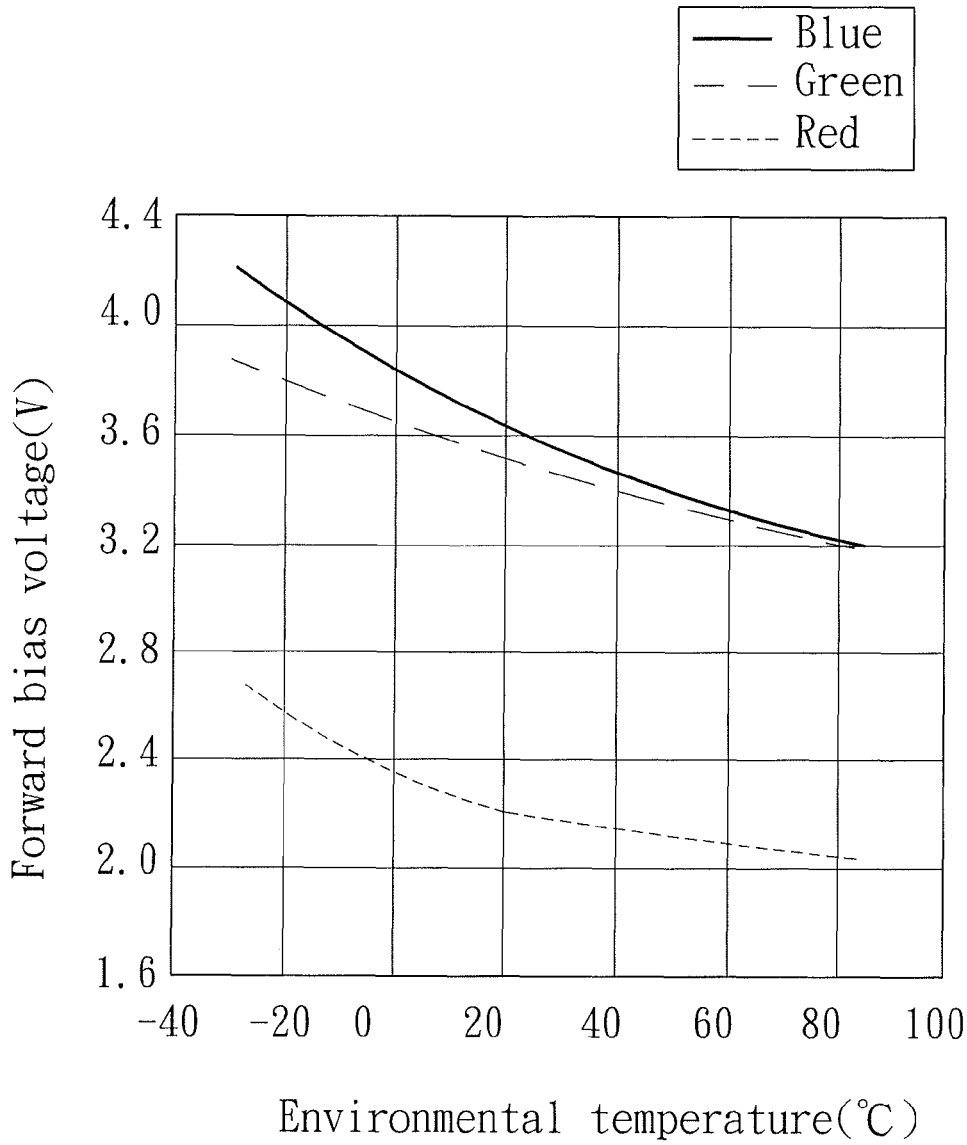
FIG. 1 PRIOR ART
FIG. 1 is a plot illustrating that a light-emitting diode (LED) has a forward bias voltage varying with environmental temperature when driven under a constant working current.
Figure 2:
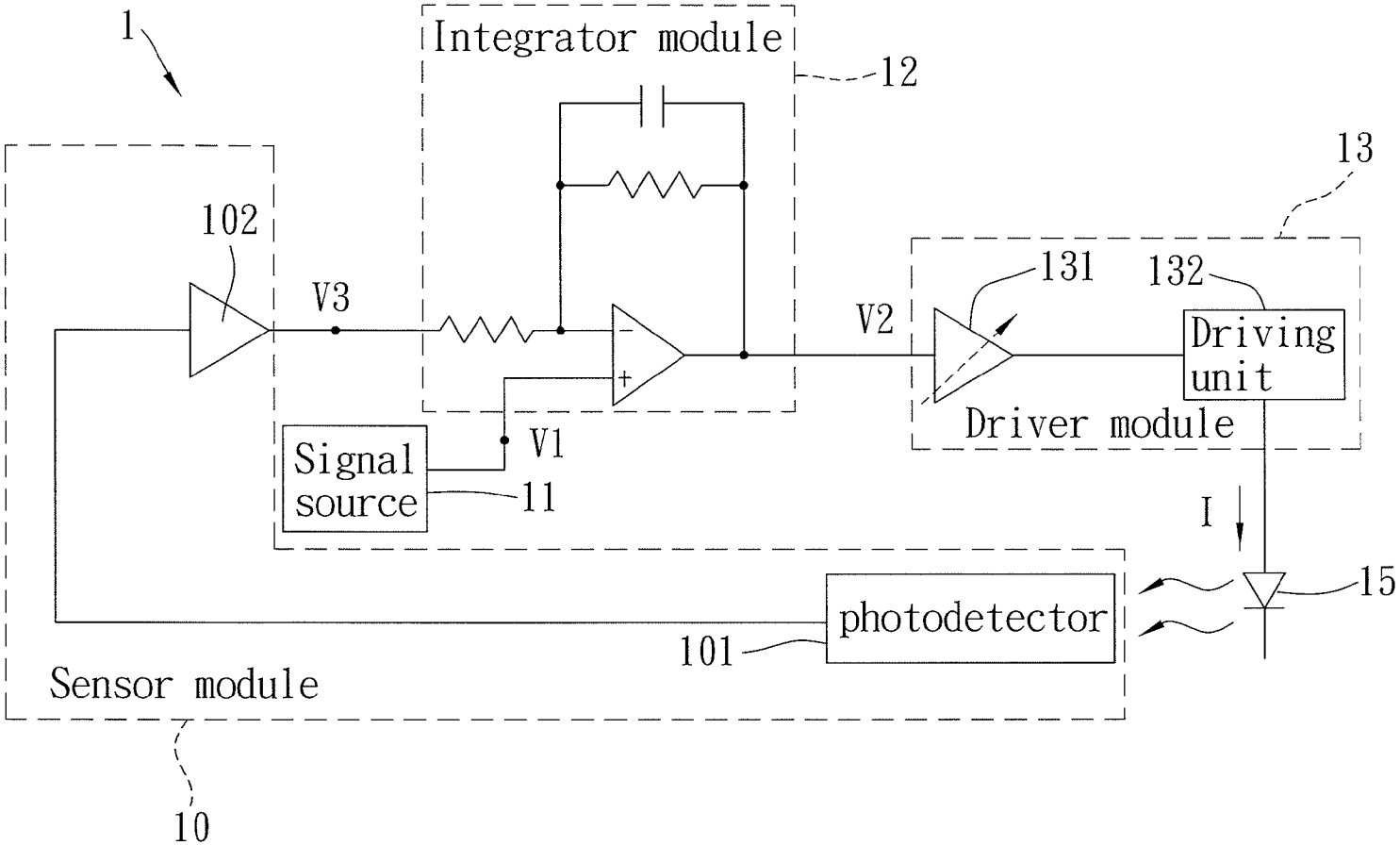
FIG. 2 PRIOR ART
FIG. 2 is a schematic circuit diagram illustrating a conventional light power compensation circuit.
Figure 3:
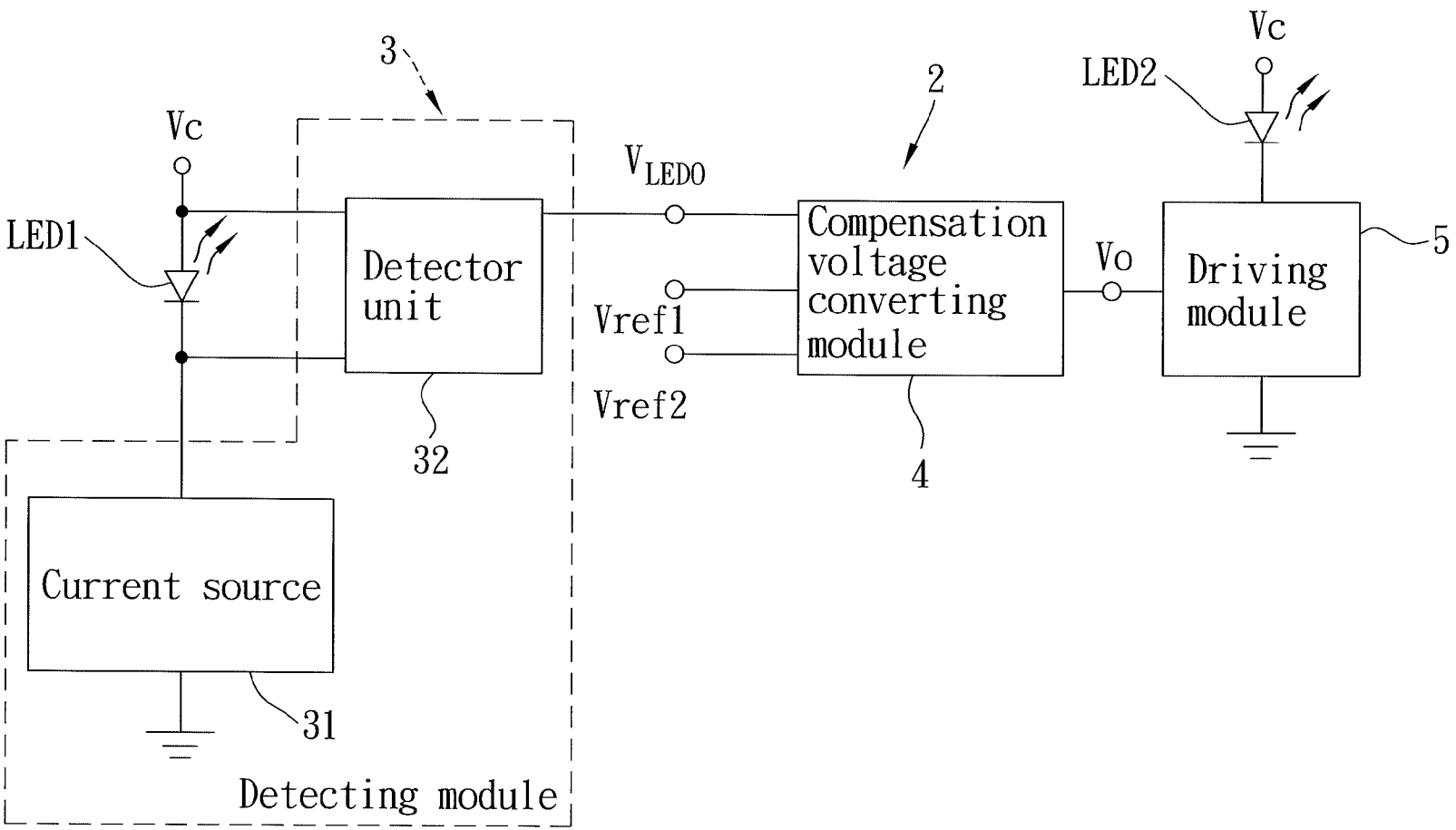
FIG. 3 is a block diagram illustrating a first preferred embodiment of a light power compensation device according to the present invention.

Referring to FIG. 3, a first preferred embodiment of a light power compensation device according to the present invention is adapted for compensating light power of a controlled light-emitting device which varies with environmental temperature. In this embodiment, a controlled light-emitting diode 2 (LED2) is provided as an example of the controlled light-emitting device. The controlled LED2 has an anode for connection to a common voltage node Vc, and a cathode. The light power compensation device comprises a temperature-detecting member and a light power compensation circuit 2. In this embodiment, a temperature-detecting LED1 is provided as an example of the temperature-detecting member. The temperature-detecting LED1 and the controlled LED2 have substantially the same environmental temperature to forward bias voltage characteristic. The temperature-detecting LED1 may have a color different from that of the controlled LED2. For example, the temperature-detecting LED1 may be a red LED when the controlled LED2, which may be selected among a red, a green and a blue LED, is driven so as to reduce complexity in circuit design.

Further, a number of the controlled LED2 is not limited to one, and there may be a plurality of controlled LED2. However, only one controlled LED2 is shown in FIG. 3 for convenience of illustration.

The temperature-detecting LED1 provides a forward bias voltage $V_{LED}$ thereacross that varies in a negative relation to change in environmental temperature when driven under a constant current, and has a cathode and an anode for connection to the common voltage node Vc.

The light power compensation circuit 2 is electrically coupled to the temperature-detecting LED1 and is to be electrically coupled to the controlled LED2. The light power compensation circuit 2 includes a detecting module 3, a compensation voltage converting module 4 and a driving module 5.

Figure 4:
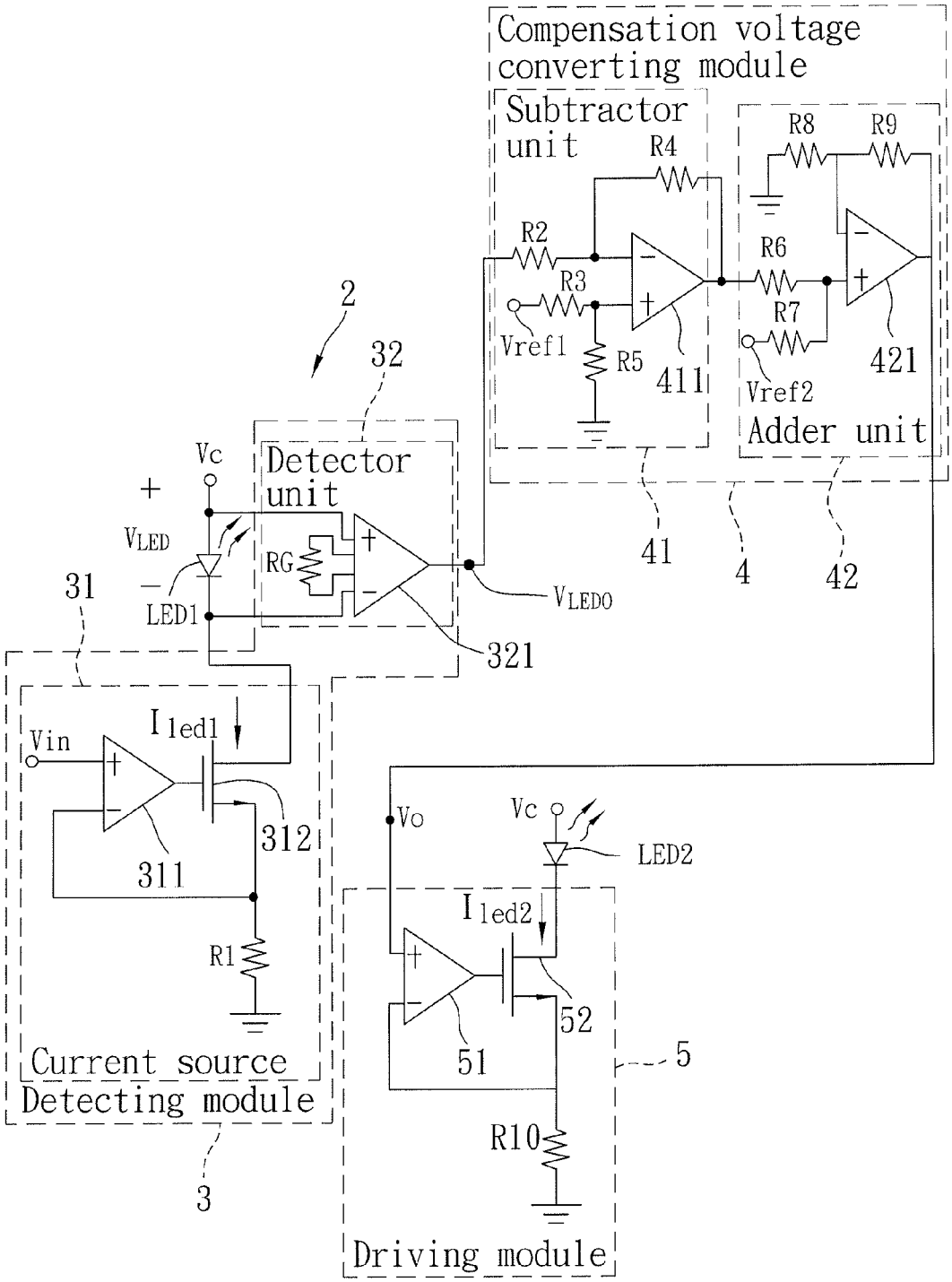
FIG. 4 is a circuit diagram of the first preferred embodiment.

Referring further to FIG. 4, the detecting module 3 includes a current source 31 and a detector unit 32.

The current source 31 is electrically coupled to the temperature-detecting LED1, and provides a working current for the temperature-detecting LED1. The current source 31 includes a source input terminal for receiving an input voltage Vin, and a source output terminal electrically coupled to the cathode of the temperature-detecting LED1. The current source 31 converts the input voltage Vin into a constant working current Iled1, which flows through the temperature-detecting LED1 and the source output terminal.

The current source 31 further includes a source operational amplifier 311, a source transistor 312 and a first resistor R1.

The source transistor 312 has a first source transistor terminal electrically coupled to the source output terminal, a second source transistor terminal, and a source transistor control terminal. In this embodiment, the source transistor 312 is a n-type metal-oxide-semiconductor field-effect transistor (nMOSFET), the first source transistor terminal is a drain terminal, the second source transistor terminal is a source terminal, and the source transistor control terminal is a gate terminal.

The source operational amplifier 311 has a source amplifier inverting input terminal (−) electrically coupled to the second source transistor terminal, a source amplifier non-inverting input terminal (+) electrically coupled to the source input terminal, and a source amplifier output terminal electrically coupled to the source transistor control terminal.

The first resistor R1 is for electrically coupling the second source transistor terminal to ground, and has a resistance $R_1$. Since the current source 31 adopts a negative feedback design which has a high input impedance and a high output impedance, and since there is a virtual short effect, which results from a high gain of the source amplifier, between the source amplifier inverting input terminal (−) and the source amplifier non-inverting input terminal (+) the working current Iled1=Vin/$R_1$. Moreover, since both the input voltage V1 and the first resistor R1 are constant, the working current Iled1 is constant.

The detector unit 32 has a first detector input terminal electrically coupled to the anode of the temperature-detecting LED1, a second detector input terminal electrically coupled to the cathode of the temperature-detecting LED1, and a detector output terminal. The detector unit 32 detects the forward bias voltage $V_{LED}$ across the temperature-detecting LED1 and provides a detector voltage $V_{LEDO}$ at the detector output terminal. The detector voltage $V_{LEDO}$ is proportional to the forward bias voltage $V_{LED}$, in which a variation $\Delta V_{LED}$ of the forward bias voltage $V_{LED}$ has a relation to change in environmental temperature of the temperature-detecting LED1. Therefore, when the environmental temperature changes, the forward bias voltage $V_{LED}$ satisfies:

$$V_{LED}=V_{LED(0^\circ C.)}+\Delta V_{LED} \quad \text{Equation 1}$$

in which $V_{LED(0^\circ C.)}$ represents the forward bias voltage of the temperature-detecting LED1 when the environmental temperature is at 0° C., and $\Delta V_{LED}$ represents the variation of the forward bias voltage $V_{LED}$ corresponding to at ° C. change in the environmental temperature. In this embodiment, 0° C. is selected as a lowest operation temperature for the temperature-detecting LED1, but it is not limited to the disclosure of the preferred embodiment. For example, if the environmental temperature may reach −40° C., −40° C. may be selected as the lowest operation temperature, and $V_{LED(-40^\circ C.)}$ may be selected as a reference voltage at the lowest operation temperature.

The detector unit 32 includes a gain adjusting resistor RG and an instrumentation amplifier 321.

The instrumentation amplifier 321 is electrically coupled to the gain adjusting resistor RG. The instrumentation amplifier 321 has a detecting amplifier non-inverting input terminal (+) electrically coupled to the first detector input terminal, a detecting amplifier inverting input terminal (−) electrically coupled to the second detector input terminal, and a detecting amplifier output terminal electrically coupled to the detector output terminal. A gain of the detector unit 32 is dependent on the gain adjusting resistor RG. In this embodiment, the gain adjusting resistor RG is selected such that the gain of the detector unit 32 is set to one, and such that the detector voltage $V_{LEDO}$ provided at the detecting amplifier output terminal has a value equal to that of the forward bias voltage $V_{LED}$.

The compensation voltage converting module 4 has a first compensator input terminal for receiving a first reference voltage Vref1, a second compensator input terminal for receiving a second reference voltage Vref2, and a third compensator input terminal electrically coupled to the detector output terminal for receiving the detector voltage $V_{LEDO}$. The compensation voltage converting module 4 converts the detector voltage $V_{LEDO}$ with reference to the first and second reference voltages Vref1, Vref2 into a compensation voltage Vo which has a negative relation to change in the detector voltage $V_{LEDO}$. In other words, when the environmental temperature of the temperature-detecting LED1 rises, the forward bias voltage $V_{LED}$ decreases and the detector voltage $V_{LEDO}$ decreases accordingly such that the compensation voltage Vo increases, and vice versa. Moreover, the first reference voltage Vref1 is preset to have a value equal to that of the forward bias voltage $V_{LED(0°\ C.)}$ of the temperature-detecting LED1 at 0° C. In other words, the first reference voltage Vref1 is the reference voltage at the lowest operation temperature. For example, if the lowest operation temperature for the temperature-detecting LED1 is −40° C., the first reference voltage Vref1 is the reference voltage $V_{LED(-40°\ C.)}$ at −40° C.

The compensation voltage converting module 4 includes a subtractor unit 41 and an adder unit 42.

The subtractor unit 41 receives the first reference voltage Vref1 and the detector voltage $V_{LEDO}$, and performs a subtraction operation thereon so as to obtain a subtractor output voltage Vsub, which satisfies:

$$\begin{aligned} Vsub &= G1 \times (Vref1 - V_{LEDO}) \\ &= G1 \times (V_{LED(0°C.)} - V_{LEDO}) \\ &= G1 \times (V_{LED(0°C.)} - V_{LED(0°C.)} - \Delta V_{LED}) \\ &= -G1 \times \Delta V_{LED}, \end{aligned} \qquad \text{Equation 2}$$

in which G1 represents a gain of the subtractor unit 41.

The subtractor unit 41 includes a subtractor operational amplifier 411, a second resistor R2, a third resistor R3, a fourth resistor R4 and a fifth resistor R5.

The subtractor operational amplifier 411 has a subtractor amplifier inverting input terminal (−), a subtractor amplifier non-inverting input terminal (+), and a subtractor amplifier output terminal providing the subtractor output voltage Vsub.

The second resistor R2 has a first end electrically coupled to the third compensator input terminal for receiving the detector voltage $V_{LEDO}$, and a second end electrically coupled to the subtractor amplifier inverting input terminal (−).

The third resistor R3 has a first end electrically coupled to the first compensator input terminal for receiving the first reference voltage Vref1, and a second end electrically coupled to the subtractor amplifier non-inverting input terminal (+).

The fourth resistor R4 has a first end electrically coupled to the subtractor amplifier inverting input terminal (−), and a second end electrically coupled to the subtractor amplifier output terminal.

The fifth resistor R5 is for electrically coupling the subtractor amplifier non-inverting input terminal (+) to ground.

In this embodiment, each of the second, third, fourth and fifth resistors R2, R3, R4, R5 has a resistance $R_2$, $R_3$, $R_4$, $R_5$, and $R_2=R_3$, $R_4=R_5$.

Therefore, the subtractor output voltage Vsub satisfies:

$$\begin{aligned} Vsub &= -\frac{R_4}{R_2} V_{LEDO} + \frac{R_5}{R_3 + R_5}\left(1 + \frac{R_4}{R_2}\right) Vref1 \\ &= \frac{R_4}{R_2}(Vref1 - V_{LEDO}) \\ &= G1 \times (Vref1 - V_{LEDO}) \end{aligned} \qquad \text{Equation 3}$$

which is equivalent to Equation 2.

Since the subtractor output voltage Vsub may be insufficient for driving the controlled LED2, an adder unit 42 is adopted for adding the second reference voltage Vref2 thereto so as to raise voltage for driving the controlled LED2 such that normal operation of the controlled LED2 may be ensured.

The adder unit 42 receives the second reference voltage Vref2 and the subtractor output voltage Vsub, and performs an addition operation thereon so as to obtain the compensation voltage Vo, which satisfies:

$$\begin{aligned} Vo &= [Vsub + Vref2] \times G2 \\ &= [Vref2 - G1 \times \Delta V_{LED}] \times G2, \end{aligned} \qquad \text{Equation 4}$$

in which G2 represents a gain of the adder unit 42.

The adder unit 42 includes an adder operational amplifier 421, a sixth resistor R6, a seventh resistor R7, an eighth resistor R8 and a ninth resistor R9.

The adder operational amplifier 421 has an adder amplifier inverting input terminal (−), an adder amplifier non-inverting input terminal (+), and an adder amplifier output terminal providing the compensation voltage Vo.

The sixth resistor R6 has a first end electrically coupled to the subtractor unit 41 for receiving the subtractor output voltage Vsub, and a second end electrically coupled to the adder amplifier non-inverting input terminal (+).

The seventh resistor R7 has a first end electrically coupled to the second compensator input terminal for receiving the second reference voltage Vref2, and a second end electrically coupled to the adder amplifier non-inverting input terminal (+).

The eighth resistor R8 is for electrically coupling the adder amplifier inverting input terminal (−) to ground.

The ninth resistor R9 has a first end electrically coupled to the adder amplifier inverting input terminal (−), and a second end electrically coupled to the adder amplifier output terminal.

In this embodiment, each of the sixth, seventh, eighth and ninth resistors R6, R7, R8, R9 has a resistance $R_6$, $R_7$, $R_8$, $R_9$, and $R_6=R_7=R_8=R_9$.

Therefore, the compensation voltage Vo satisfies:

$$Vo = [G1 \times (Vref1 - V_{LEDO}) + Vref2] \times \left\{\frac{R_7}{R_6 + R_7}\left(1 + \frac{R_9}{R_8}\right)\right\} = [G1 \times (Vref1 - V_{LEDO}) + Vref2] \times G2 = [-G1 \times \Delta V_{LED} + Vref2] \times G2 \quad \text{Equation 5}$$

which is equivalent to Equation 4.

When the environmental temperature of the temperature-detecting LED1 is at 0° C., the forward bias voltage thereof is $V_{LED(0°\ C.)}$. Therefore the detector voltage $V_{LEDO}=V_{LED(0°\ C.)}$, and as mentioned above Vref1=$V_{LED(0°\ C.)}$ such that according to Equation 5 the compensation voltage $Vo_{(0°\ C.)}$ at 0° C. satisfies: $Vo_{(0°\ C.)}$=G2×Vref2. Accordingly, a difference value of the compensation voltage Vo when there is a t° C. change in the environmental temperature may be presented as follows:

$$\{[-G1 \times \Delta V_{LED} + Vref2] \times G2\} - \{Vref2 \times G2\} = -G1G2 \times \Delta V_{LED} \quad \text{Equation 6}$$

The driving module 5 has a driver input terminal electrically coupled to the compensation voltage converting module 4 for receiving the compensation voltage Vo, and a driver output terminal to be electrically coupled to the cathode of the controlled LED2. The driving module 5 converts the compensation voltage Vo into a driving current Iled2 which is proportional to the compensation voltage Vo and which drives operation of the controlled LED2.

The driving module 5 includes a driving operational amplifier 51, a driving transistor 52, and a tenth resistor R10.

The driving transistor 52 has a first driving transistor terminal electrically coupled to the driver output terminal, a second driving transistor terminal, and a driving transistor control terminal. In this embodiment, the driving transistor 52 is a n-type metal-oxide-semiconductor field-effect transistor (nMOSFET), the first driving transistor terminal is a drain terminal, the second driving transistor terminal is a source terminal, and the driving transistor control terminal is a gate terminal.

The driving operational amplifier 51 has a driving amplifier inverting input terminal (−) electrically coupled to the second driving transistor terminal, a driving amplifier non-inverting input terminal (+) electrically coupled to the driver input terminal, and a driving amplifier output terminal electrically coupled to the driving transistor control terminal.

The tenth resistor R10 is for electrically coupling the second driving transistor terminal to ground, and has a resistance $R_{10}$ equal to $R_1$. Therefore, the driving current Iled2 may be obtained from Iled2=Vo/$R_1$. From Equation 6, when the environmental temperature of the controlled LED2 rises t° C., a variation in the driving current Iled2 increases by (−G1×G2×$\Delta V_{LED}$)/$R_1$ for compensating a decreased forward bias voltage of the controlled LED2 so as to keep light power P of the controlled LED2 staying constant.

Figure 5:
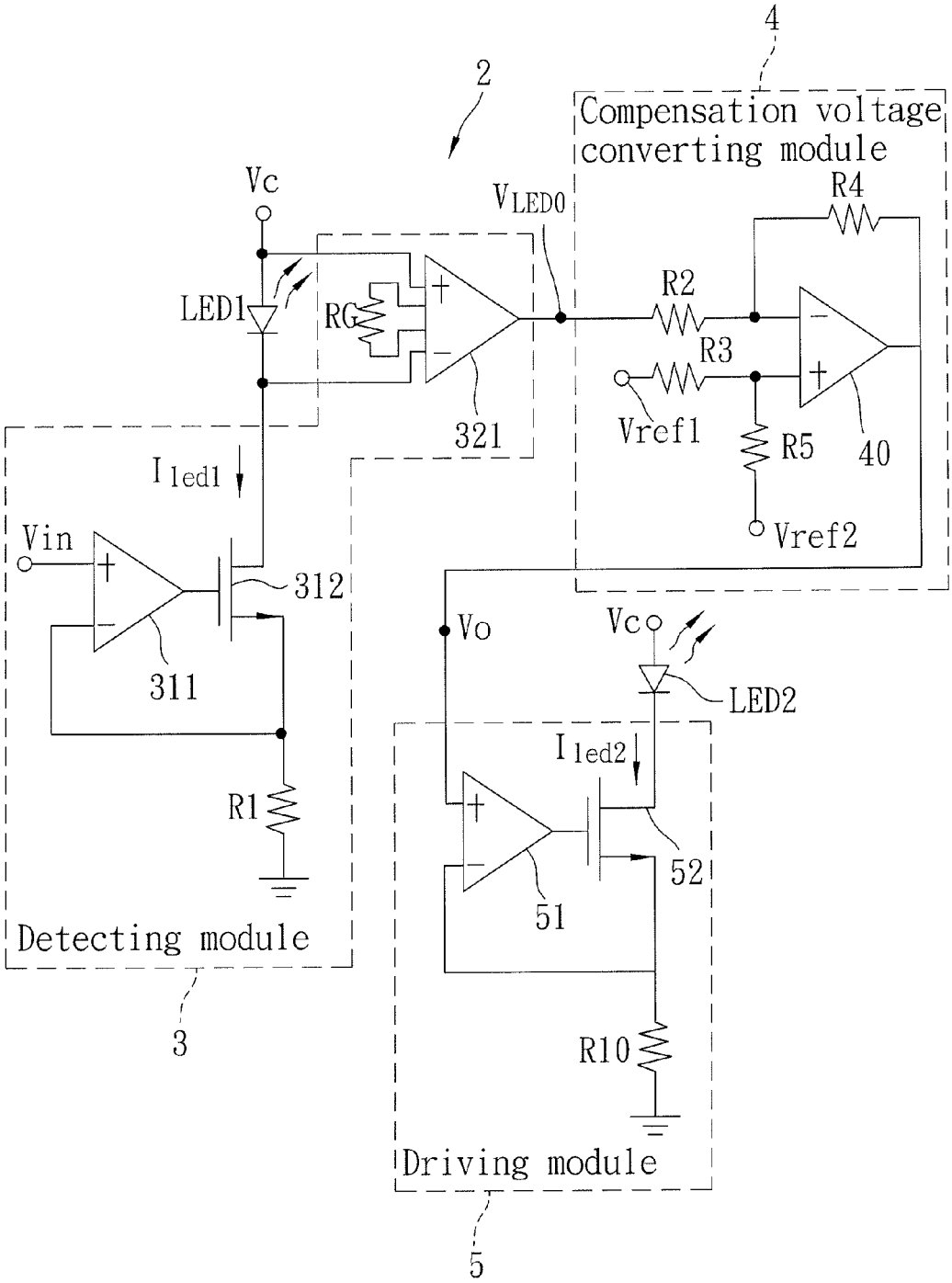
FIG. 5 is a circuit diagram illustrating a second preferred embodiment of the light power compensation device according to the present invention.

Referring to FIG. 5, a second preferred embodiment of the light power compensation device according to the present invention is illustrated. The second preferred embodiment differs from the first preferred embodiment in the configuration that:

the compensation voltage Vo provided by the compensation voltage converting module 4 satisfies:

$$Vo = G1 \times (Vref1 - V_{LEDO}) + Vref2, \quad \text{Equation 7}$$

in which G1 represents the gain of the compensation voltage converting module 4.

The compensation voltage converting module 4 includes a compensation operational amplifier 40, a second resistor R2, a third resistor R3, a fourth resistor R4 and a fifth resistor R5.

The compensation operational amplifier 40 has a compensation amplifier inverting input terminal (−), a compensation amplifier non-inverting input terminal (+), and a compensation amplifier output terminal providing the compensation voltage Vo.

The second resistor R2 has a first end electrically coupled to the third compensator input terminal for receiving the detector voltage $V_{LEDO}$, and a second end electrically coupled to the compensation amplifier inverting input terminal (−).

The third resistor R3 has a first end electrically coupled to the first compensator input terminal for receiving the first reference voltage Vref1, and a second end electrically coupled to the compensation amplifier non-inverting input terminal (+).

The fourth resistor R4 has a first end electrically coupled to the compensation amplifier inverting input terminal (−), and a second end electrically coupled to the compensation amplifier output terminal.

The fifth resistor R5 has a first end electrically coupled to the compensation amplifier non-inverting input terminal (+), and a second end electrically coupled to the second compensator input terminal for receiving the second reference voltage Vref2.

In this embodiment, each of the second, third, fourth and fifth resistors R2, R3, R4, R5 has a resistance $R_2$, $R_3$, $R_4$, $R_5$, and $R_2$=$R_3$, $R_4$=$R_5$.

Therefore, the compensation voltage Vo satisfies:

$$Vo = [G1 \times (Vref1 - V_{LEDO})] + Vref2 = \left[\frac{R_4}{R_2}(V_{LED(0°C.)} - V_{LED(0°C.)} - \Delta V_{LED})\right] + Vref2. \quad \text{Equation 8}$$

When the environmental temperature of the temperature-detecting LED1 is at 0° C., the forward bias voltage thereof is $V_{LED(0°\ C.)}$. Therefore, the detector voltage $V_{LEDO}=V_{LED(0°\ C.)}$ such that according to Equation 8 the compensation voltage $Vo_{(0°\ C.)}$ at 0° C. satisfies:

$$Vo_{(0°\ C.)} = Vref2.$$

Specifically, in other configurations of the preferred embodiment, the lowest operation temperature is not limited to 0° C., and the first reference voltage Vref1 is equal to the reference voltage at the lowest operation temperature.

Accordingly, a difference value of the compensation voltage Vo when there is a t° C. change in the environmental temperature may be presented as follows:

$$[-G1 \times \Delta V_{LED} + Vref2] - Vref2 = -G1 \times \Delta V_{LED}. \quad \text{Equation 9}$$

Therefore, from Equation 9, when the environmental temperature of the controlled LED2 rises t° C., a variation in the driving current Iled2 increases by (−G1×$\Delta V_{LED}$)/$R_1$ for compensating a decreased forward bias voltage of the controlled LED2 so as to keep the light power P of the controlled LED2 constant.

Figure 6:
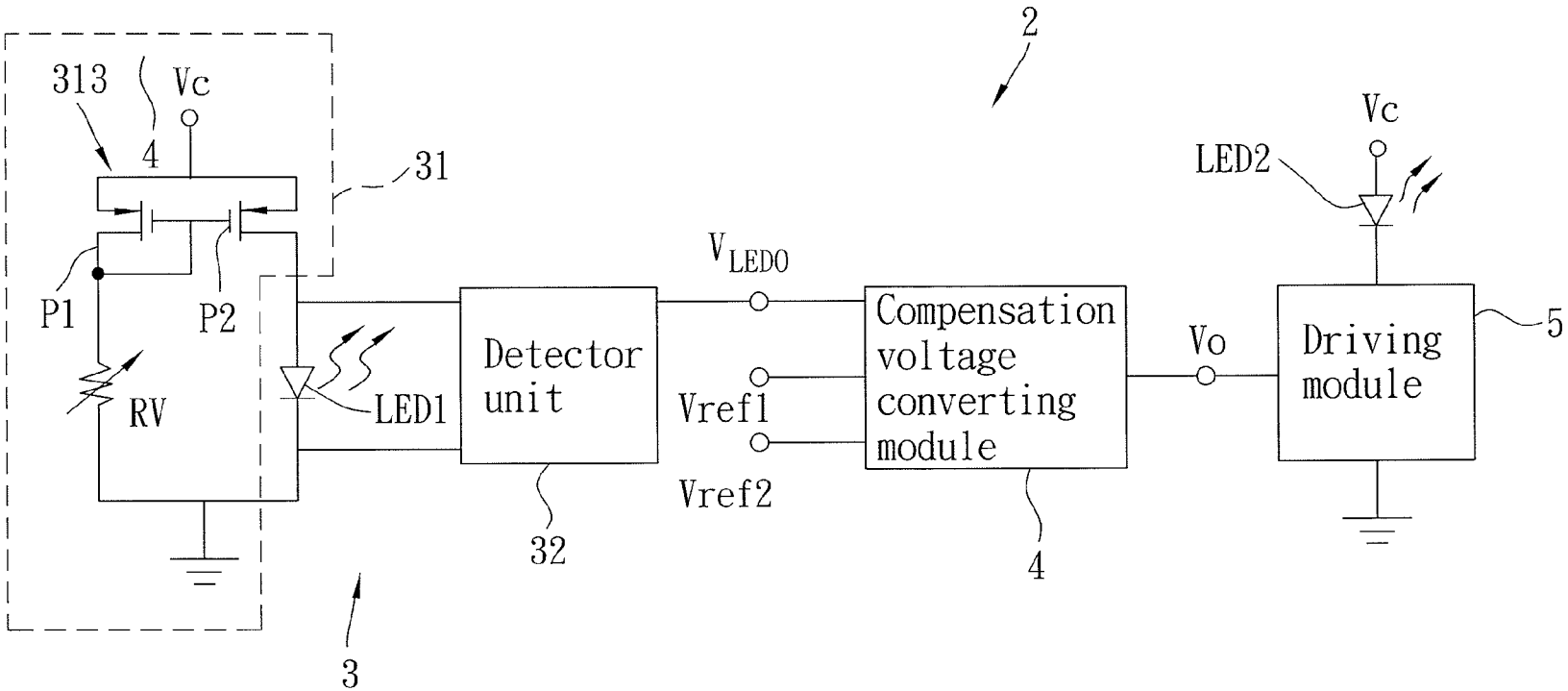
FIG. 6 is a circuit diagram illustrating a third preferred embodiment of the light power compensation device according to the present invention.

Referring to FIG. 6, a third preferred embodiment of the light power compensation device according to the present invention is for compensating light power of a controlled LED2 which varies with change in environmental temperature. The controlled LED2 has an anode for connection to a common voltage node Vc, and a cathode. The light power compensation device comprises a temperature-detecting LED1 and a light power compensation circuit 2.

The temperature-detecting LED1 has an anode and a grounded cathode.

The light power compensation circuit 2 is electrically coupled to the temperature-detecting LED1 and is to be electrically coupled to the controlled LED2. The light power compensation circuit 2 includes a detecting module 3, a compensation voltage converting module 4 and a driving module 5.

The detecting module 3 includes a current source 31 and a detector unit 32.

The current source 31 includes a current mirror 313 and a variable resistor RV.

The variable resistor RV has a first end and a grounded second end, and is for generating a bias current which varies with resistance of the variable resistor RV.

The current mirror 313 is electrically coupled to the variable resistor RV for flow of the bias current, is electrically coupled to the anode of the temperature-detecting LED1, and generates a working current corresponding in magnitude to the bias current for driving operation of the temperature-detecting LED1. The current mirror 313 includes a first mirror transistor P1 and a second mirror transistor P2.

The first mirror transistor P1 has a first terminal for connection to the common voltage node Vc, a second terminal electrically coupled to the first end of the variable resistor RV, and a control terminal electrically coupled to the first end of the variable resistor RV.

The second mirror transistor P2 has a first terminal for connection to the common voltage node Vc, a second terminal electrically coupled to the anode of the temperature-detecting LED1, and a control terminal electrically coupled to the first end of the variable resistor RV.

In this embodiment, each of the first and second mirror transistors P1, P2 is a p-type metal-oxide-semiconductor field-effect transistor (pMOSFET). In other configurations of this embodiment, the current mirror 313 may be formed from a bipolar junction transistors (PNP transistors), or may have a reversed style of connection, i.e., each of the variable resistor RV and the temperature-detecting LED1 is connected between the common voltage node Vc and the first and second mirror transistors P1, P2, and each of the first and second mirror transistors P1, P2 is an n-type MOSFET (nMOSFET) or an NPN BJT transistor.

The first terminal of each of the first and second mirror transistors P1, P2 is a source terminal, the second terminal of each of the first and second mirror transistors P1, P2 is a drain terminal, and the control terminal of each of the first and second mirror transistors P1, P2 is a gate terminal.

Moreover, detailed components and circuit operations of the detector unit 32, the compensation voltage converting module 4 and the driving module 5 are substantially the same as those illustrated in the first preferred embodiment, and will not be described further for the sake of brevity.

Figure 7:
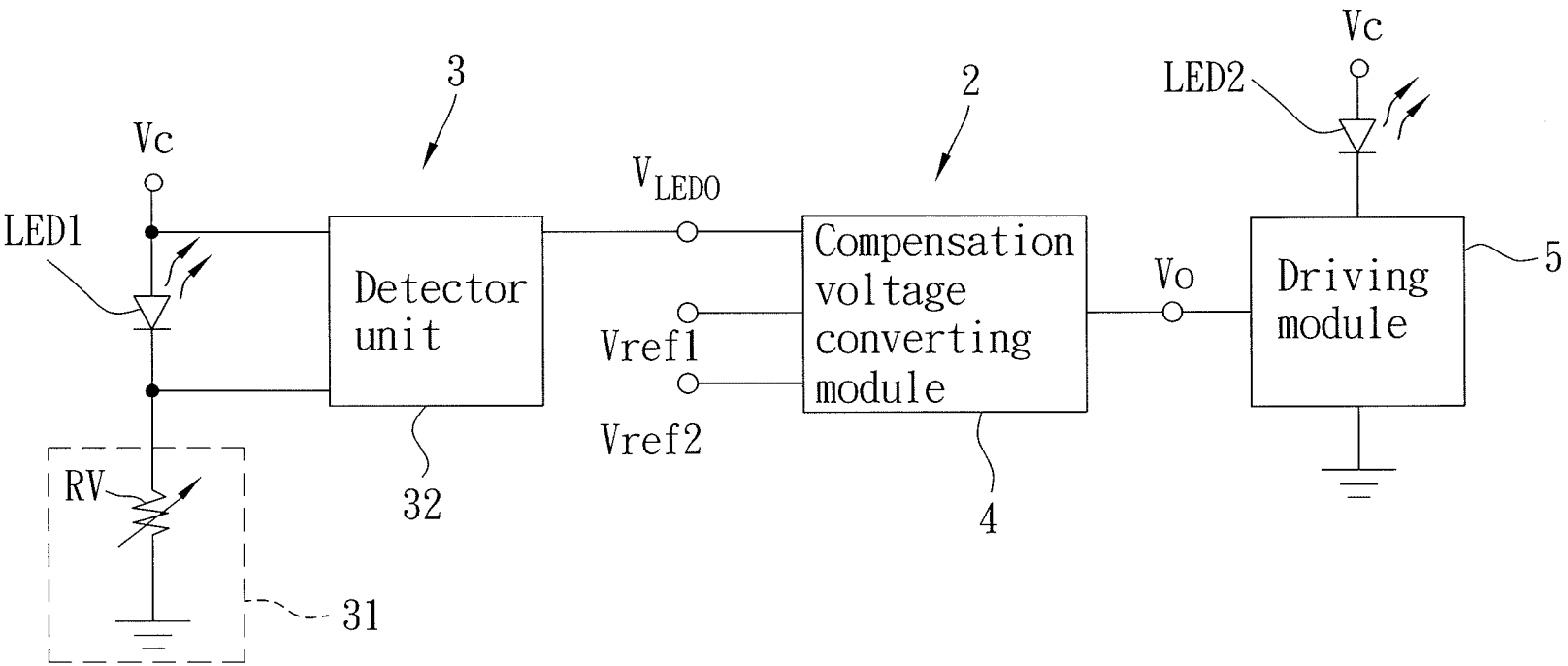
FIG. 7 is a circuit diagram illustrating a fourth preferred embodiment of the light power compensation device according to the present invention.

Referring to FIG. 7, a fourth preferred embodiment of the light power compensation device according to the present invention is for compensating light power of a controlled LED2 which varies with change in environmental temperature. The controlled LED2 has an anode for connection to a common voltage node Vc, and a cathode. The light power compensation device comprises a temperature-detecting LED1 and a light power compensation circuit 2.

The temperature-detecting LED1 has an anode and a cathode.

The light power compensation circuit 2 is electrically coupled to the temperature-detecting LED1 and is to be electrically coupled to the controlled LED2. The light power compensation circuit 2 includes a detecting module 3, a compensation voltage converting module 4 and a driving module 5.

The detecting module 3 includes a current source 31 and a detector unit 32.

The current source 31 includes a variable resistor RV electrically coupled between the cathode of the temperature-detecting LED1 and ground. The current source 31 generates a working current which varies with resistance of the variable resistor RV, and provides the working current for driving operation of the temperature-detecting LED1.

Moreover, detailed components and circuit operations of the detector unit 32, the compensation voltage converting module 4 and the driving module 5 are substantially the same as those illustrated in the first preferred embodiment, and will not be described further for the sake of brevity.

Figure 8:
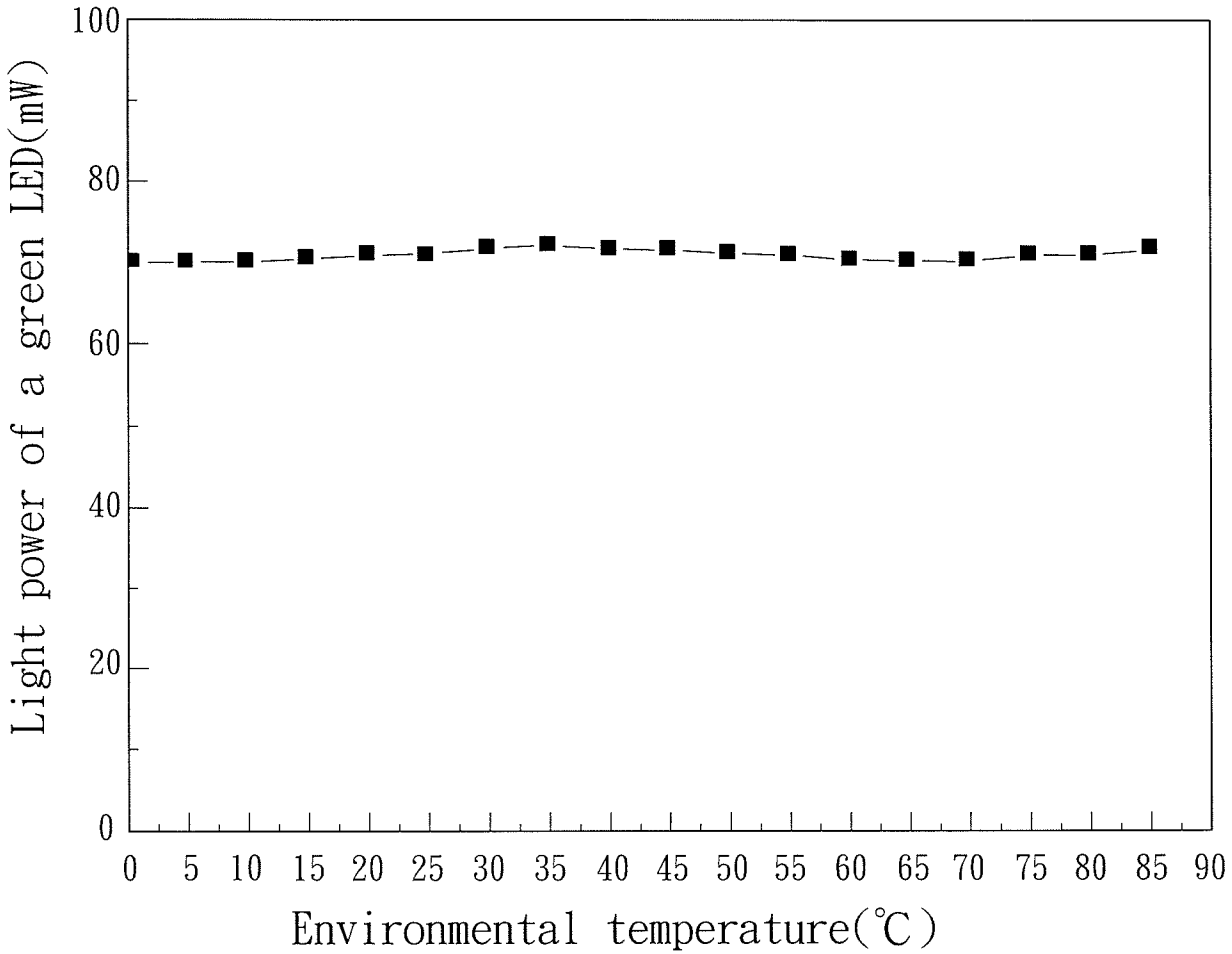
FIG. 8 illustrates an experimental result obtained using the first preferred embodiment of the present invention applied to a green LED.
Figure 9:
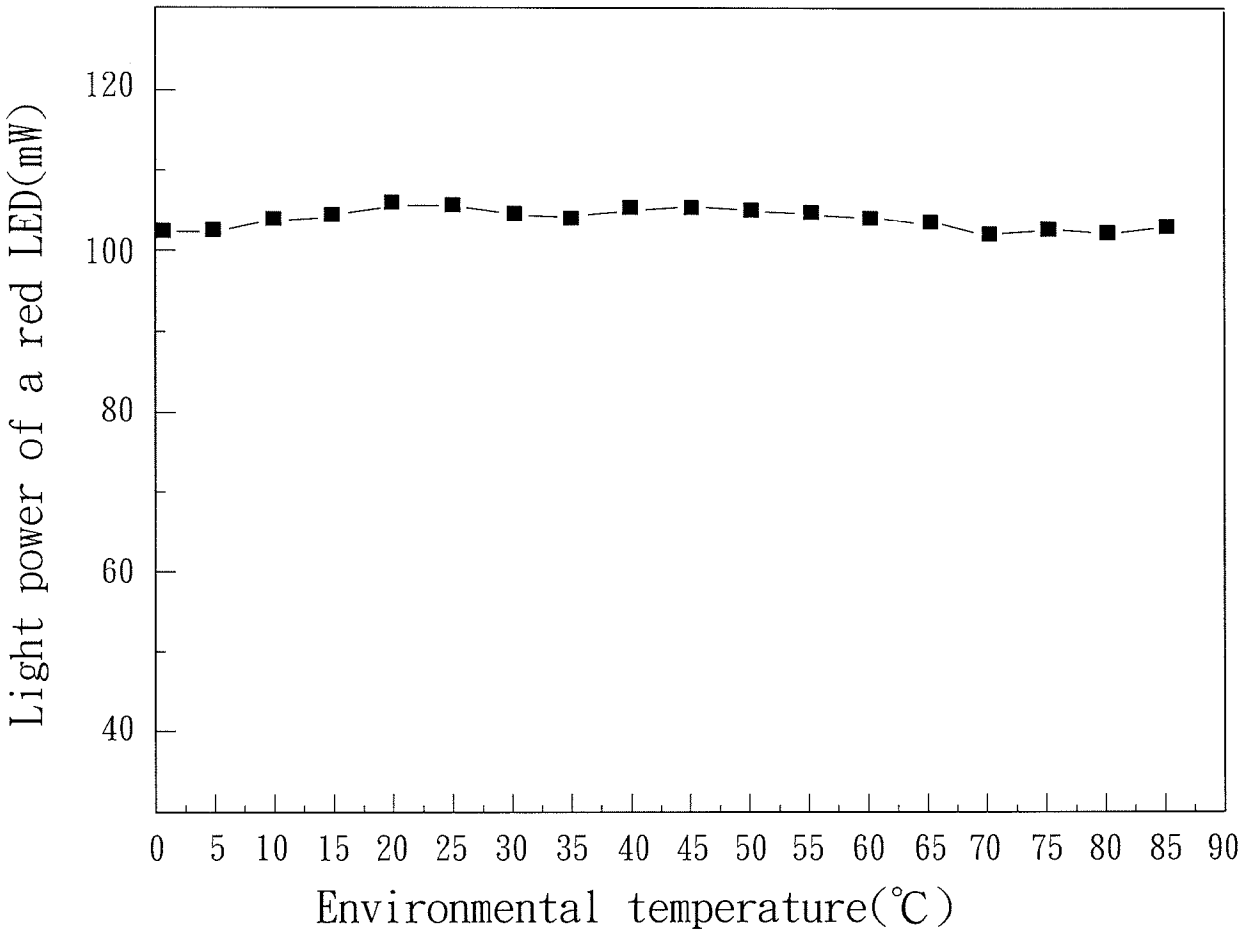
FIG. 9 illustrates an experimental result obtained using the first preferred embodiment of the present invention applied to a red LED.
Figure 10:
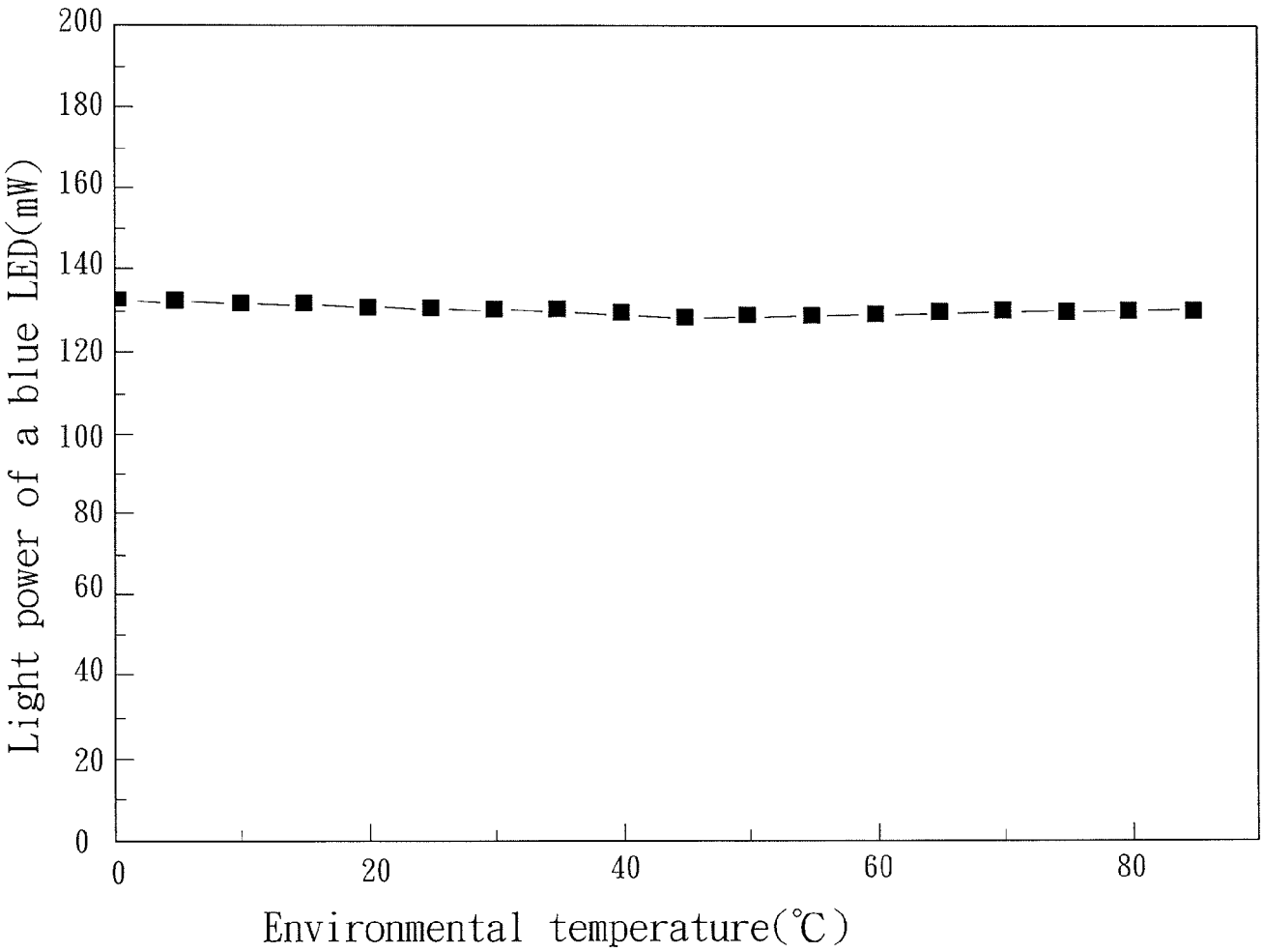
FIG. 10 illustrates an experimental result obtained using the first preferred embodiment of the present invention applied to a blue LED.

Referring to FIG. 8 to FIG. 10, each of experimental results of the first preferred embodiment applied to a respective one of a green LED, a red LED and a blue LED is illustrated. When the environmental temperature rises from 0° C. to 85° C., light power of the green LED is substantially fixed at 70 mW, light power of the red LED is substantially fixed at 100 mW, and light power of the blue LED is substantially fixed at 130 mW.

Figure 11:
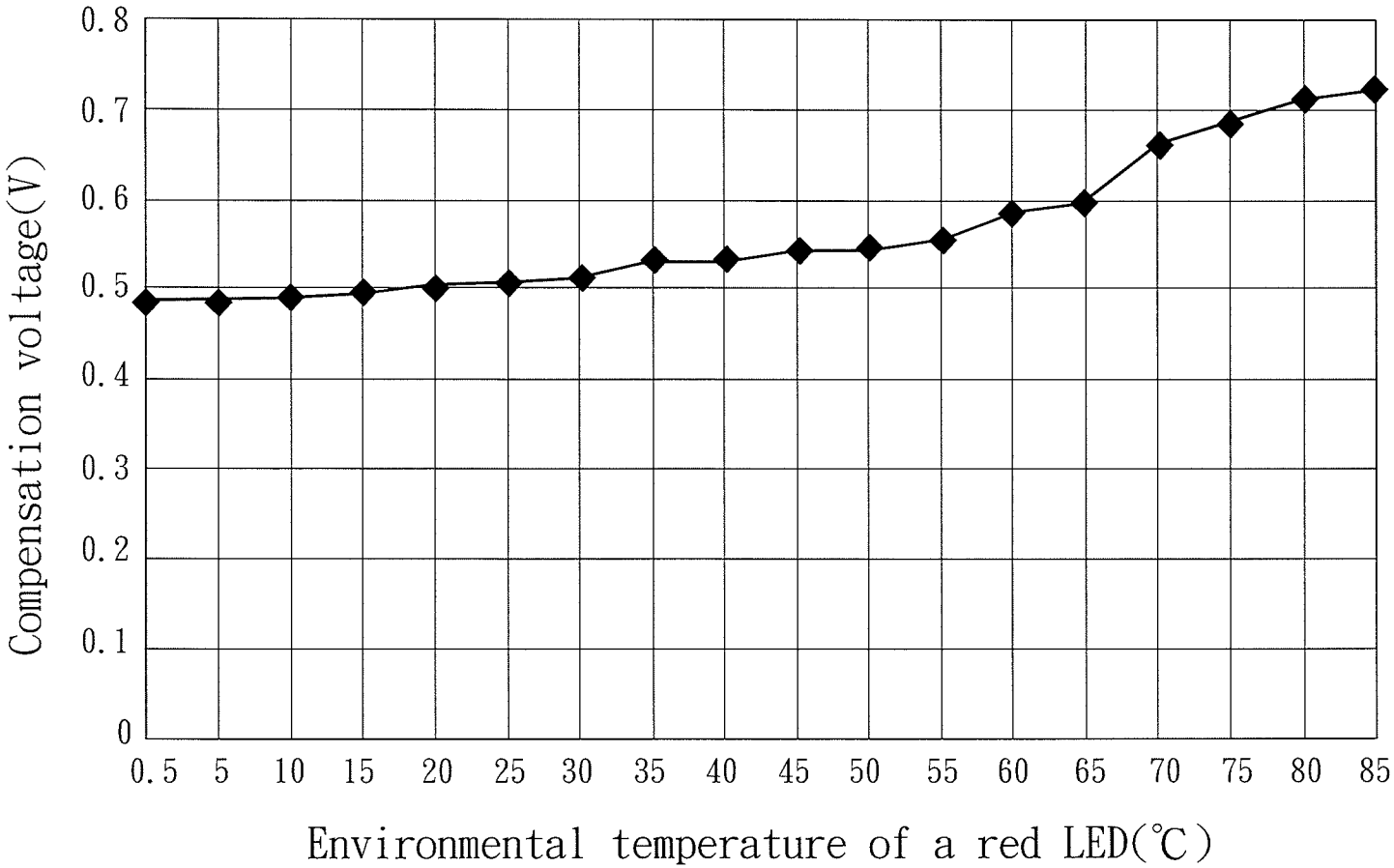
FIG. 11 illustrates an experimental result of a compensation voltage required for keeping light power of a red LED steady.

Referring to FIG. 11, an experimental result of a compensation voltage required for keeping light power of a red LED steady is illustrated, in which $R_2=R_3=100K\Omega$, $R_4=R_5=44.8K\Omega$.

Figure 12:
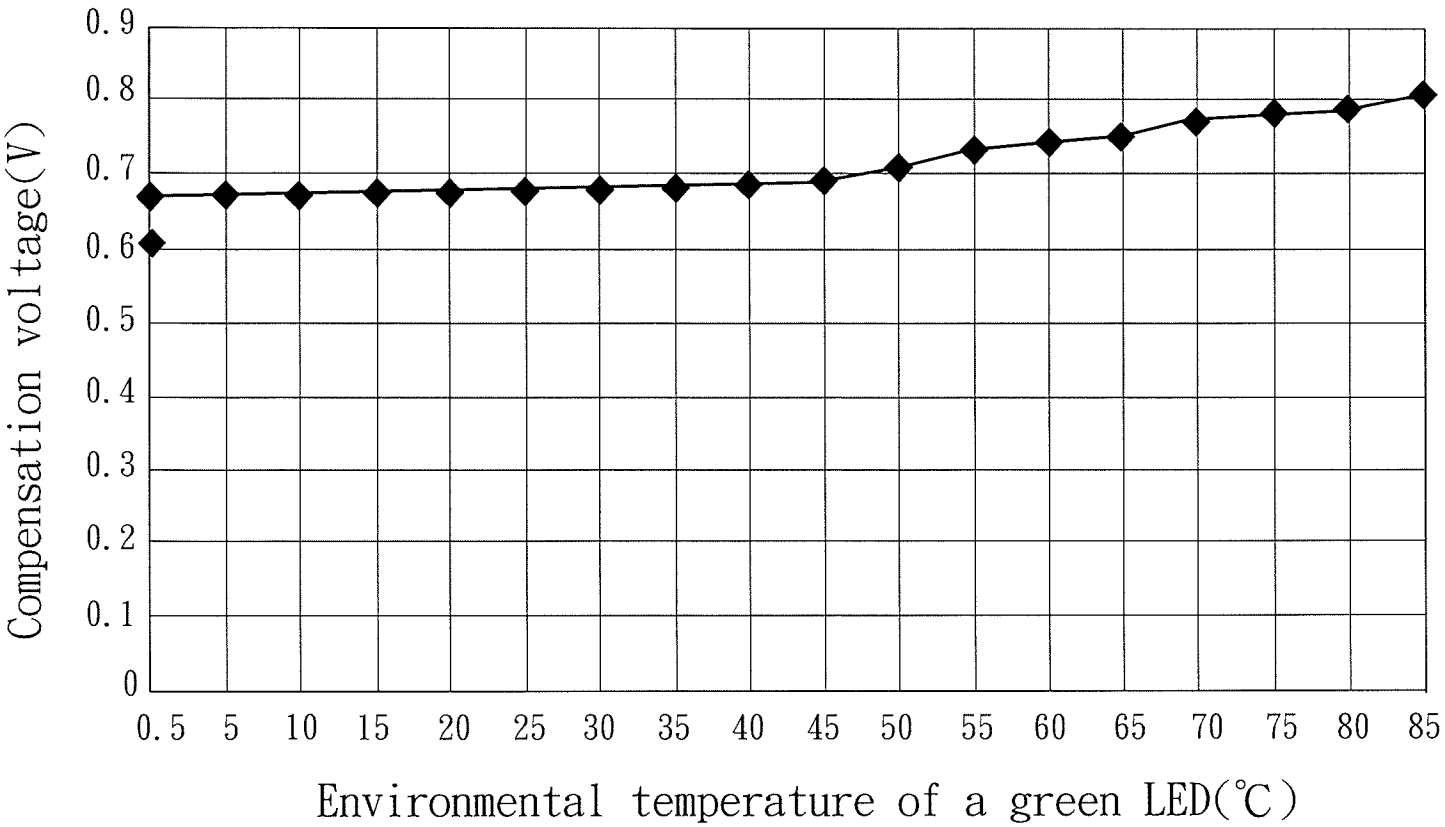
FIG. 12 illustrates an experimental result of a compensation voltage required for keeping light power of a green LED steady.

Referring to FIG. 12, an experimental result of a compensation voltage required for keeping light power of a green LED steady is illustrated, in which $R_2=R_3=100K\Omega$, $R_4=R_5=72.4K\Omega$.

Figure 13:
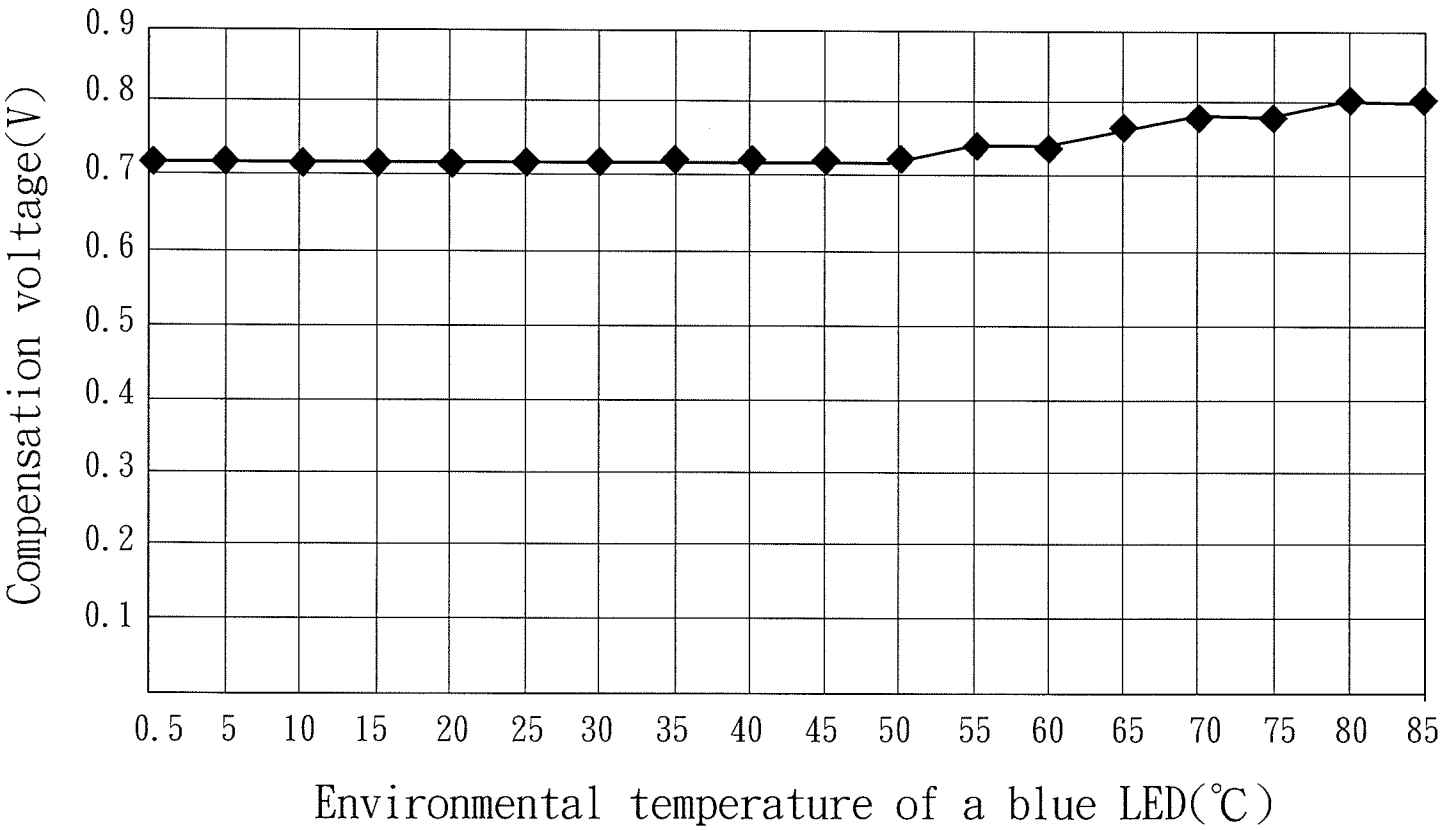
FIG. 13 illustrates an experimental result of a compensation voltage required for keeping light power of a blue LED steady.

Referring to FIG. 13, an experimental result of a compensation voltage required for keeping light power of a blue LED steady is illustrated, in which $R_2=R_3=100K\Omega$, $R_4=R_5=72.4K\Omega$.

Notably, each of the temperature-detecting light-emitting device and the controlled light-emitting device is not limited to the temperature-detecting LED1 and the controlled LED2, respectively. In other configurations of the present invention, the temperature-detecting LED1 may be replaced by a temperature-detecting laser diode, and the controlled LED2 may be replaced by a controlled laser diode.

In summary, the aforementioned preferred embodiments have advantages of:

The detecting module 3 is electrically coupled to the temperature-detecting LED1 directly, and detects the forward bias voltage thereof which varies with change in environment temperature. Compared with a conventional photodetector which detects light beams emitted from the controlled LED2 directly, the light power compensation device of the present invention may alleviate inaccuracy in light power control resulting from insufficient directivity of the light beams, ambient light interference and sensitivity of the photodetector. Therefore, the detector voltage $V_{LEDO}$ obtained from the detecting module 3 which varies with change in temperature is relatively accurate so as to achieve the effect of keeping light power steady.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light power compensation device for compensating light power of a controlled light-emitting device, the controlled light-emitting device being a controlled light-emitting diode (LED) or a controlled laser diode, the controlled light-emitting device having an anode for connection to a voltage node, and a cathode, said light power compensation device comprising:

a temperature-detecting light-emitting device which provides a forward bias voltage thereacross that varies in a negative relation to change in environmental temperature when driven under a constant current, and which has an anode and a cathode, said temperature-detecting light-emitting device being a temperature-detecting LED or a temperature-detecting laser diode; and a light power compensation circuit electrically coupled to said temperature-detecting light-emitting device and to be electrically coupled to the controlled light-emitting device, said light power compensation circuit including:

a detecting module including:

a current source electrically coupled to said temperature-detecting light-emitting device, and providing a working current for said temperature-detecting light-emitting device; and a detector unit having a first detector input terminal electrically coupled to said anode of said temperature-detecting light-emitting device, a second detector input terminal electrically coupled to said cathode of said temperature-detecting light-emitting device, and a detector output terminal, said detector unit detecting the forward bias voltage across said temperature-detecting light-emitting device and providing a detector voltage at said detector output terminal, the detector voltage being proportional to the forward bias voltage;

a compensation voltage converting module having a first compensator input terminal for receiving a first reference voltage, a second compensator input terminal for receiving a second reference voltage, and a third compensator input terminal electrically coupled to said detector output terminal for receiving the detector voltage, said compensation voltage converting module converting the detector voltage with reference to the first and second reference voltages into a compensation voltage which has a negative relation to change in the detector voltage; and a driving module having a driver input terminal electrically coupled to said compensation voltage converting module for receiving the compensation voltage, and a driver output terminal to be electrically coupled to the cathode of the controlled light-emitting device, said driving module converting the compensation voltage into a driving current which is proportional to the compensation voltage and which drives operation of the controlled light-emitting device.

2. The light power compensation device as claimed in claim 1, wherein said current source includes:

a source input terminal for receiving an input voltage;

a source output terminal electrically coupled to said cathode of said temperature-detecting light-emitting device;

a source transistor having a first source transistor terminal electrically coupled to said source output terminal, a second source transistor terminal, and a source transistor control terminal;

a source operational amplifier having a source amplifier inverting input terminal electrically coupled to said second source transistor terminal, a source amplifier non-inverting input terminal electrically coupled to said source input terminal, and a source amplifier output terminal electrically coupled to said source transistor control terminal; and a first resistor for electrically coupling said second source transistor terminal to ground.

3. The light power compensation device as claimed in claim 1, wherein said detector unit includes:

a gain adjusting resistor; and an instrumentation amplifier electrically coupled to said gain adjusting resistor, said instrumentation amplifier having a detecting amplifier non-inverting input terminal electrically coupled to said first detector input terminal, a detecting amplifier inverting input terminal electrically coupled to said second detector input terminal, and a detecting amplifier output terminal electrically coupled to said detector output terminal;

a gain of said detector unit being dependent on said gain adjusting resistor.

4. The light power compensation device as claimed in claim 1, wherein said compensation voltage converting module includes:

a subtractor unit receiving the first reference voltage and the detector voltage, and performing a subtraction operation thereon so as to obtain a subtractor output voltage, which satisfies: $Vsub=G1\times(Vref1-V_{LEDO})$, in which Vsub represents the subtractor output voltage, Vref1 represents the first reference voltage, $V_{LEDO}$ represents the detector voltage, and G1 represents a gain of said subtractor unit; and an adder unit receiving the second reference voltage and the subtractor output voltage, and performing an addition operation thereon so as to obtain the compensation voltage, which satisfies: $Vo=[Vsub+Vref2]\times G2$, in which Vo represents the compensation voltage, Vref2 represents the second reference voltage, and G2 represents a gain of said adder unit.

5. The light power compensation device as claimed in claim 1, wherein said driving module includes:

a driving transistor having a first driving transistor terminal electrically coupled to said driver output terminal, a second driving transistor terminal, and a driving transistor control terminal;

a driving operational amplifier having a driving amplifier inverting input terminal electrically coupled to said second driving transistor terminal, a driving amplifier non-inverting input terminal electrically coupled to said driver input terminal, and a driving amplifier output terminal electrically coupled to said driving transistor control terminal; and a tenth resistor for electrically coupling said second driving transistor terminal to ground.

6. The light power compensation device as claimed in claim 1, wherein the compensation voltage from said compensation voltage converting module satisfies: $Vo=G1\times(Vref1-V_{LEDO})+Vref2$, in which Vo represents the compensation voltage, Vref1 represents the first reference voltage, $V_{LEDO}$ represents the detector voltage, Vref2 represents the second reference voltage, and G1 represents a gain of said compensation voltage converting module.

7. The light power compensation device as claimed in claim 1, wherein said current source includes:

a variable resistor for generating a bias current which varies with resistance of said variable resistor; and a current mirror that is electrically coupled to said variable resistor for flow of the bias current, that is electrically coupled to said anode of said temperature-detecting light-emitting device, and that generates a working current corresponding in magnitude to the bias current for driving operation of said temperature-detecting light-emitting device.

8. The light power compensation device as claimed in claim 1, wherein said current source includes a variable resistor electrically coupled between said cathode of said temperature-detecting light-emitting device and ground, said current source generating a working current which varies with resistance of said variable resistor and providing the working current for driving operation of said temperature-detecting light-emitting device.

9. A light power compensation circuit for connecting electrically to a temperature-detecting light-emitting device and a controlled light-emitting device, the temperature-detecting light-emitting device being a temperature detecting light-emitting diode (LED) or a temperature-detecting laser diode, the controlled light-emitting device being a controlled LED or a controlled laser diode, each of the temperature-detecting light-emitting device and the controlled light-emitting device having an anode and a cathode, the anode of the temperature-detecting light-emitting device being electrically coupled to a voltage node, the temperature-detecting light-emitting device providing a forward bias voltage thereacross that varies in a negative relation to change in environmental temperature when driven under a constant current, said light power compensation circuit comprising:

a detecting module including:

a current source to be electrically coupled to the temperature-detecting light-emitting device, and providing a working current for the temperature-detecting light-emitting device; and a detector unit having a first detector input terminal to be electrically coupled to the anode of the temperature-detecting light-emitting device, a second detector input terminal to be electrically coupled to the cathode of the temperature-detecting light-emitting device, and a detector output terminal, said detector unit being operable to detect the forward bias voltage across the temperature-detecting light-emitting device and providing a detector voltage at said detector output terminal, the detector voltage being proportional to the forward bias voltage;

a compensation voltage converting module having a first compensator input terminal for receiving a first reference voltage, a second compensator input terminal for receiving a second reference voltage, and a third compensator input terminal electrically coupled to said detector output terminal for receiving the detector voltage, said compensation voltage converting module converting the detector voltage with reference to the first and second reference voltages into a compensation voltage which has a negative relation to change in the detector voltage; and a driving module having a driver input terminal electrically coupled to said compensation voltage converting module for receiving the compensation voltage, and a driver output terminal to be electrically coupled to the cathode of the controlled light-emitting device, said driving module converting the compensation voltage into a driving current which is proportional to the compensation voltage and which drives operation of the controlled light-emitting device.

10. The light power compensation circuit as claimed in claim 9, wherein said current source includes:

a source input terminal for receiving an input voltage;

a source output terminal to be electrically coupled to the cathode of the temperature-detecting light-emitting device;

a source transistor having a first source transistor terminal electrically coupled to said source output terminal, a second source transistor terminal, and a source transistor control terminal;

a source operational amplifier having a source amplifier inverting input terminal electrically coupled to said second source transistor terminal, a source amplifier non-inverting input terminal electrically coupled to said source input terminal, and a source amplifier output terminal electrically coupled to said source transistor control terminal; and a first resistor for electrically coupling said second source transistor terminal to ground.

11. The light power compensation circuit as claimed in claim 9, wherein said detector unit includes:

a gain adjusting resistor; and an instrumentation amplifier electrically coupled to said gain adjusting resistor, said instrumentation amplifier having a detecting amplifier non-inverting input terminal electrically coupled to said first detector input terminal, a detecting amplifier inverting input terminal electrically coupled to said second detector input terminal, and a detecting amplifier output terminal electrically coupled to said detector output terminal;

a gain of said detector unit being dependent on said gain adjusting resistor.

12. The light power compensation circuit as claimed in claim 9, wherein said compensation voltage converting module includes:

a subtractor unit receiving the first reference voltage and the detector voltage, and performing a subtraction operation thereon so as to obtain a subtractor output voltage, which satisfies: $Vsub=G1\times(Vref1-V_{LEDO})$, in which Vsub represents the subtractor output voltage, Vref1 represents the first reference voltage, $V_{LEDO}$ represents the detector voltage, and G1 represents a gain of said subtractor unit; and an adder unit receiving the second reference voltage and the subtractor output voltage, and performing an addition operation thereon so as to obtain the compensation voltage, which satisfies: $Vo=[Vsub+Vref2]\times G2$, in which Vo represents the compensation voltage, Vref2 represents the second reference voltage, and G2 represents a gain of said adder unit.

13. The light power compensation circuit as claimed in claim 9, wherein said driving module includes:

a driving transistor having a first driving transistor terminal electrically coupled to said driver output terminal, a second driving transistor terminal, and a driving transistor control terminal;

a driving operational amplifier having a driving amplifier inverting input terminal electrically coupled to said second driving transistor terminal, a driving amplifier non-inverting input terminal electrically coupled to said driver input terminal, and a driving amplifier output terminal electrically coupled to said driving transistor control terminal; and a tenth resistor for electrically coupling said second driving transistor terminal to ground.

14. The light power compensation circuit as claimed in claim 9, wherein the compensation voltage from said compensation voltage converting module satisfies: $Vo=G1\times(Vref1-V_{LEDO})+Vref2$, in which Vo represents the compensation voltage, Vref1 represents the first reference voltage, $V_{LEDO}$ represents the detector voltage, Vref2 represents the second reference voltage, and G1 represents a gain of said compensation voltage converting module.

15. The light power compensation circuit as claimed in claim 9, wherein said current source includes:

a variable resistor for generating a bias current which varies with resistance of said variable resistor; and a current mirror that is electrically coupled to said variable resistor for flow of the bias current, that is to be electrically coupled to the anode of the temperature-detecting light-emitting device, and that generates a working current corresponding in magnitude to the bias current for driving operation of the temperature-detecting light-emitting device.

16. The light power compensation circuit as claimed in claim 9, wherein said current source includes a variable resistor to be electrically coupled between the cathode of the temperature-detecting light-emitting device and ground, said current source generating a working current which varies with resistance of said variable resistor and providing the working current for driving operation of the temperature-detecting light-emitting device.

17. A detecting module to be electrically coupled to a temperature-detecting light-emitting device, the temperature-detecting light-emitting device being a temperature-detecting light-emitting diode (LED) or a temperature-detecting laser diode, the temperature-detecting light-emitting device providing a forward bias voltage thereacross that varies in a negative relation to change in environmental temperature when driven under a constant current, and having a cathode and an anode, said detecting module comprising:

a current source to be electrically coupled to the temperature-detecting light-emitting device, and providing a working current for the temperature-detecting light-emitting device, wherein said current source includes a source input terminal for receiving an input voltage, a source output terminal to be electrically coupled to the cathode of the temperature-detecting light-emitting device, a source transistor having a first source transistor terminal electrically coupled to said source output terminal, a second source transistor terminal, and a source transistor control terminal, a source operational amplifier having a source amplifier inverting input terminal electrically coupled to said second source transistor terminal, a source amplifier non-inverting input terminal electrically coupled to said source input terminal, and a source amplifier output terminal electrically coupled to said source transistor control terminal, and a first resistor for electrically coupling said second source transistor terminal to ground; and a detector unit having a first detector input terminal to be electrically coupled to the anode of the temperature-detecting light-emitting device, a second detector input terminal to be electrically coupled to the cathode of the temperature-detecting light-emitting device, and a detector output terminal, said detector unit being operable to detect the forward bias voltage across the temperature-detecting light-emitting device and providing a detector voltage at said detector output terminal, the detector voltage being proportional to the forward bias voltage.

18. The detecting module as claimed in claim 17, wherein said detector unit includes:

a gain adjusting resistor; and an instrumentation amplifier electrically coupled to said gain adjusting resistor, said instrumentation amplifier having a detecting amplifier non-inverting input terminal electrically coupled to said first detector input terminal, a detecting amplifier inverting input terminal electrically coupled to said second detector input terminal, and a detecting amplifier output terminal electrically coupled to said detector output terminal;

a gain of said detector unit being dependent on said gain adjusting resistor.

* * * * *